US008308393B2

(12) United States Patent
Jetté

(10) Patent No.: US 8,308,393 B2
(45) Date of Patent: Nov. 13, 2012

(54) DETACHABLE BARRIER HAVING MAGNETIC RETAINER

(75) Inventor: Gaétan Jetté, Mascouche (CA)

(73) Assignee: 9172-9863 Quebec Inc., Terrebonne, Quebec (CA)

( * ) Notice: Subject to any disclaimer, the term of this patent is extended or adjusted under 35 U.S.C. 154(b) by 0 days.

(21) Appl. No.: 12/661,025

(22) Filed: Mar. 9, 2010

(65) Prior Publication Data

US 2011/0222962 A1 Sep. 15, 2011

(30) Foreign Application Priority Data

Mar. 10, 2009 (CA) ..... 2657744

(51) Int. Cl.
*E01F 9/018* (2006.01)

(52) U.S. Cl. ..... 404/10; 404/9; 49/49; 49/385

(58) Field of Classification Search ..... 49/9, 34, 49/49, 73.1, 102, 385; 404/6, 9, 10; 40/606.15
See application file for complete search history.

(56) References Cited

U.S. PATENT DOCUMENTS

| | | | | |
|---|---|---|---|---|
| 494,390 | A * | 3/1893 | Smith | 49/124 |
| 1,689,257 | A * | 10/1928 | Sawyer | 49/9 |
| 6,460,292 | B1 * | 10/2002 | Rodriguez et al. | 49/49 |
| 6,618,993 | B2 * | 9/2003 | Burke | 49/49 |
| 6,997,417 | B2 * | 2/2006 | Zarkades | 246/125 |
| 7,065,923 | B2 * | 6/2006 | Parsadayan et al. | 49/141 |
| 7,533,494 | B2 * | 5/2009 | Burke | 49/49 |
| 7,690,860 | B1 * | 4/2010 | Utz | 404/9 |
| 7,768,399 | B2 * | 8/2010 | Hachmann et al. | 340/568.1 |
| 7,814,706 | B2 * | 10/2010 | Gamache | 49/49 |
| 2006/0228177 | A1 * | 10/2006 | Allain et al. | 404/6 |

* cited by examiner

*Primary Examiner* — Gary S Hartmann
(74) *Attorney, Agent, or Firm* — Ipaxio S.E.N.C.

(57) ABSTRACT

A device for securing a passageway comprising a barrier on a mounting member, the barrier being retained by magnetic attraction between the mounting member and the barrier, the mounting member being pivotably moveable between operative and inoperative positions.

11 Claims, 6 Drawing Sheets

DETACHABLE BARRIER HAVING MAGNETIC RETAINER

FIELD OF THE INVENTION

The present invention relates to a safety device and more particularly relates to a safety device for barring a passageway.

The use of a bar or barrier to block passage through a passageway finds use in many different situations. Generally, the bar or barrier is utilized to alert a person or a vehicle that there should not be any passage. While many different types of bars or barriers are utilized, one consideration in certain situations is that the barrier should not cause or incur damage if it is impacted. Otherwise, the cost of repairing or replacing the bar or barrier can be substantial, especially when it is a relatively frequent occurrence.

Barriers can be used in many different situations whenever it is decided to impede or stop traffic from flowing. This may be at an intersection where it is desirable to halt either pedestrian or vehicular traffic from crossing in a certain direction at a certain time. The barriers may also be used in situations where it is desirable to remind a person not to proceed unless certain steps are taken.

SUMMARY OF THE INVENTION

It is an object of the present invention to provide a breakaway bar or barrier which is sufficiently strong to perform its function as a barrier while having a breakaway arrangement whereby damage to the barrier is minimized when accidentally hit.

The barrier arrangement of the present invention may be utilized in any number of different situations such as set forth above. Thus, it can be used in conjunction with other safety devices such as with loading and unloading docks, intersections, and in any situation where it is appropriate to bar a passageway or the like.

The barrier components may be formed of any suitable material with the proviso that one or more portions thereof are of a magnetic metallic material. However, the other portions may be formed of suitable materials such as metals or plastics or the like.

The activation of the barrier may be accomplished by different means as will be discussed hereinbelow. It suffices to say that many different suitable activation/deactivation devices arrangements may be employed: these may be manual, mechanical or electrical, etc.

BRIEF DESCRIPTION OF THE DRAWINGS

Having thus generally described the invention, reference will be made to the accompanying drawings illustrating an embodiment thereof, in which.

DETAILED DESCRIPTION OF THE INVENTION

Figure 1:
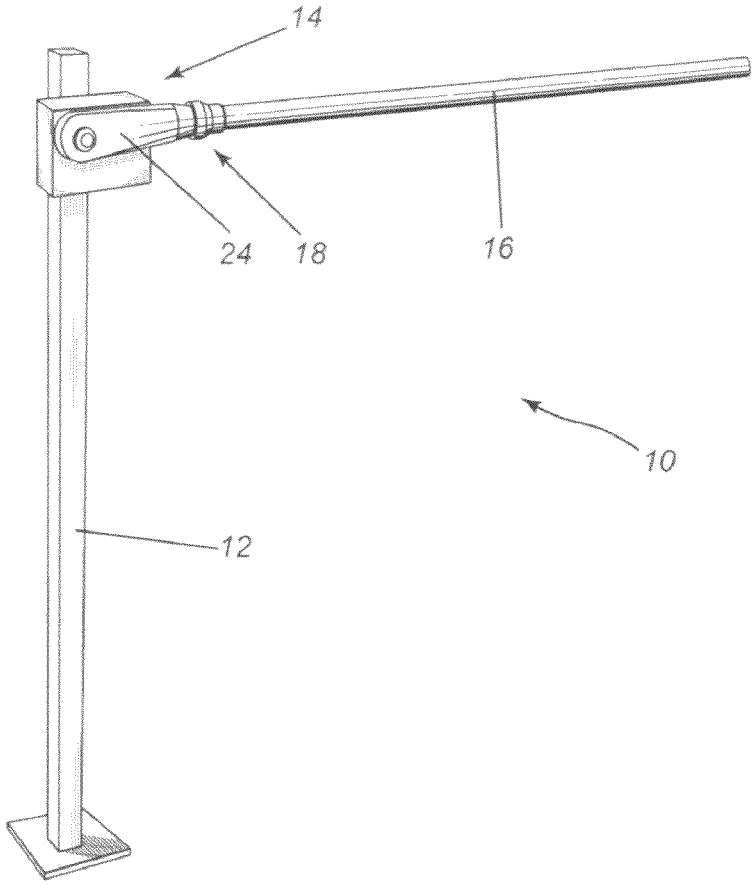
FIG. 1 is a perspective view of a barrier according to one embodiment of the present invention.
Figure 2:
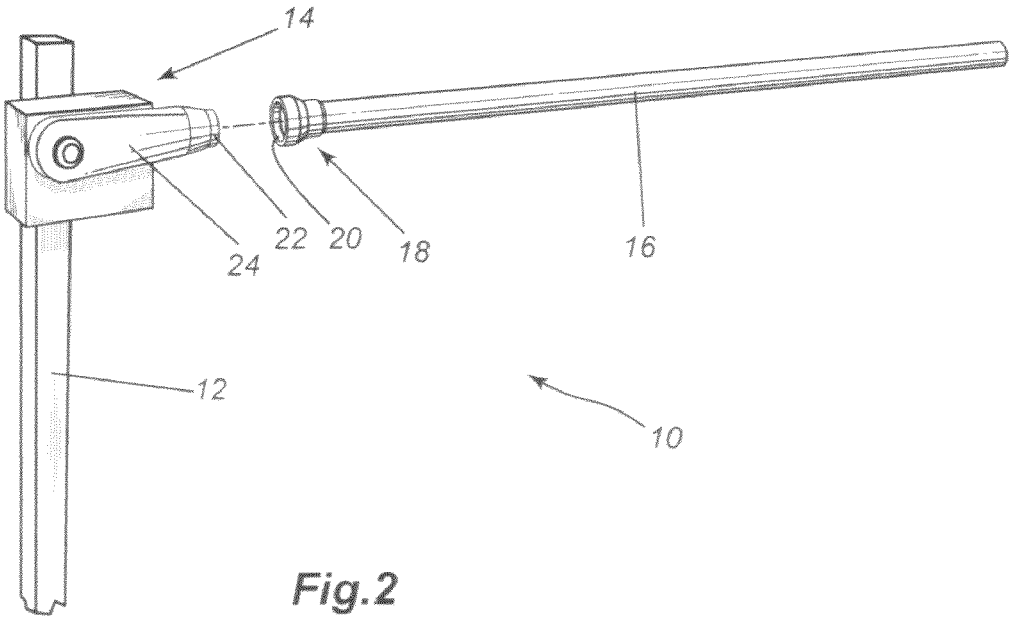
FIG. 2 is a partially exploded view thereof.

Referring to the drawings in greater detail and by reference characters thereto, there is illustrated in FIG. 1 a barrier which is in an operative position—i.e. to bar a passageway. The barrier is generally designated by reference numeral 10.

The barrier is mounted on a post 12 adjacent a passageway which is to be barred. It will be understood that barrier 10 can also be mounted on any convenient structure adjacent the passageway.

Barrier 10 includes a mounting device generally designated by reference numeral 14 and which is designed to receive a bar 16. Bar 16 conveniently can have a proximal end 18 with a magnetic portion 20 located thereat. Mounting device 14 includes a receptacle 22 for receiving magnetic portion 20 of proximal end 18.

Mounting device 14 also includes a pivot portion 24 which can, in the illustrated embodiment, pivot through approximately 90° to move bar 16 from a horizontal position to a vertical position. Naturally, the degree of pivot can be either more or less depending on the particular situation.

In the illustrated embodiment, bar 16 has the magnetic portion 20 which is attracted to receptacle 22 which is of a suitable metallic material. It will be understood that this is merely one possible arrangement with others also capable of being utilized. Thus, in addition to magnetic portion 20, receptacle 22 may also be magnetic, but of an opposite polarity. Still further, receptacle 22 could include the magnetic material while bar 16 is of a suitable metallic material. It suffices to say that such arrangements are within the skill of one knowledgeable in the art. Similarly, the particularly magnetic arrangement and the strength thereof may be varied according to the particular circumstances. One could utilize multiple magnets if desired.

Figure 3:
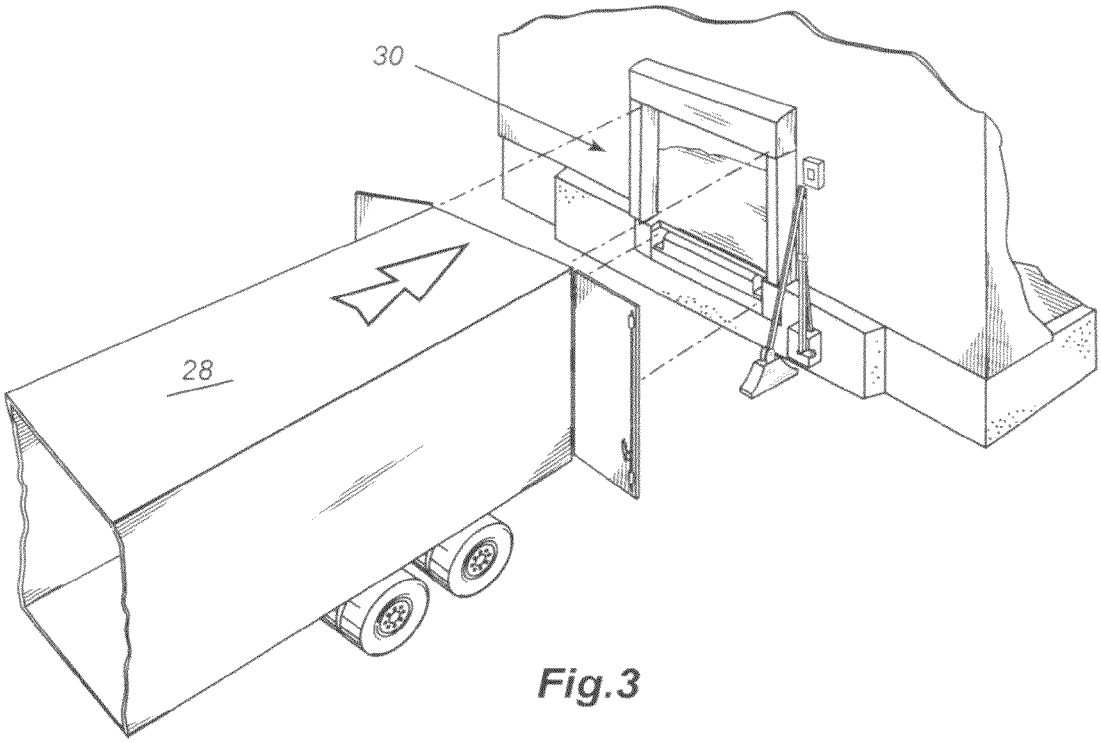
FIG. 3 illustrates where the barrier may be utilized in conjunction with a loading/unloading situation.
Figure 4:
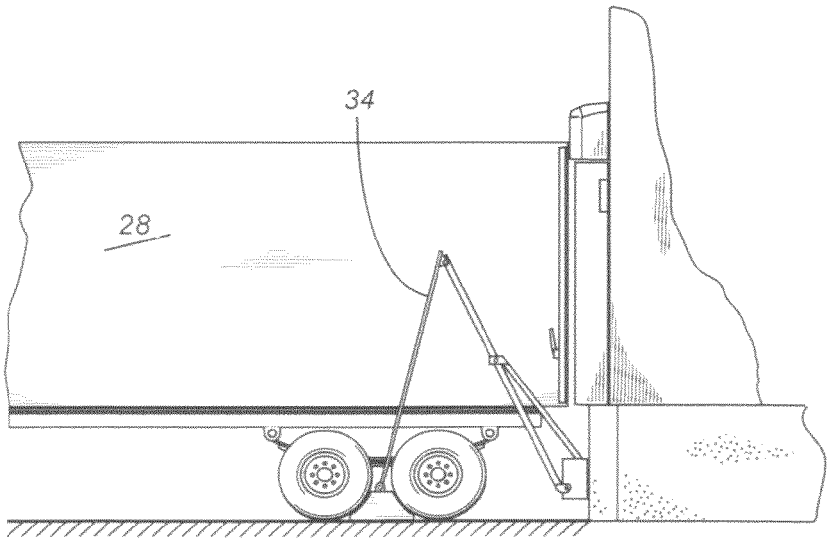
FIG. 4 illustrates the trailer backed up to a door utilizing the barrier of the present invention.

As shown in FIG. 3, a trailer 28 is backing up to a loading dock 30. When in position, a safety locking device 34 is utilized on the wheels of the trailer.

Figure 5:
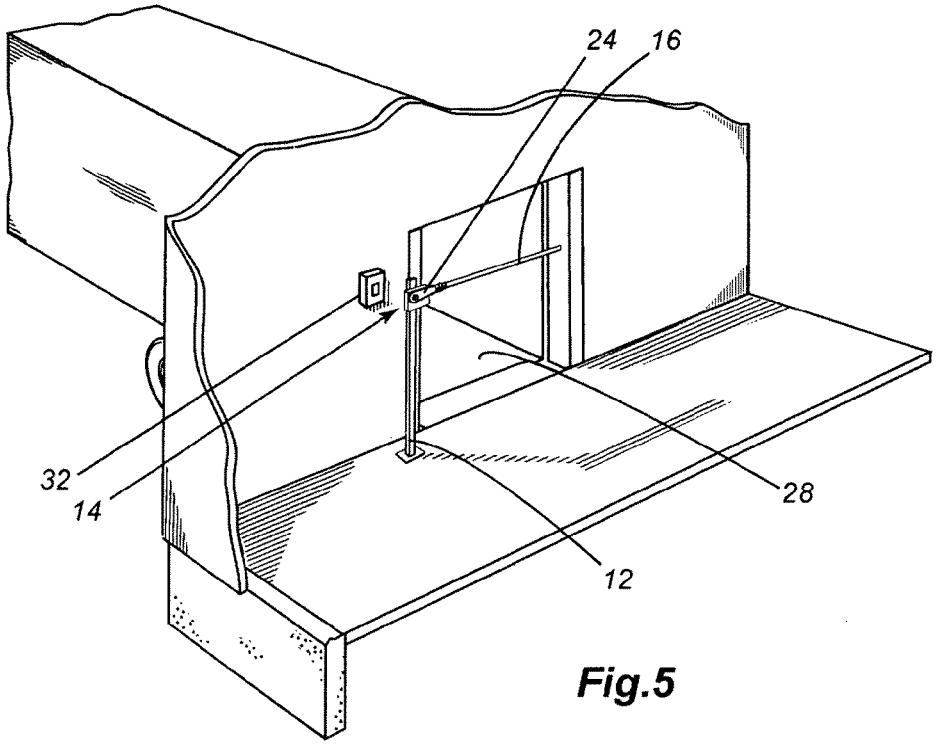
FIG. 5 is an illustration of the barrier in an operative position.

FIG. 5 illustrates a position wherein the barrier is operative to block passageway into the trailer. This can, for example, be the position when the trailer is not yet in position.

Figure 6:
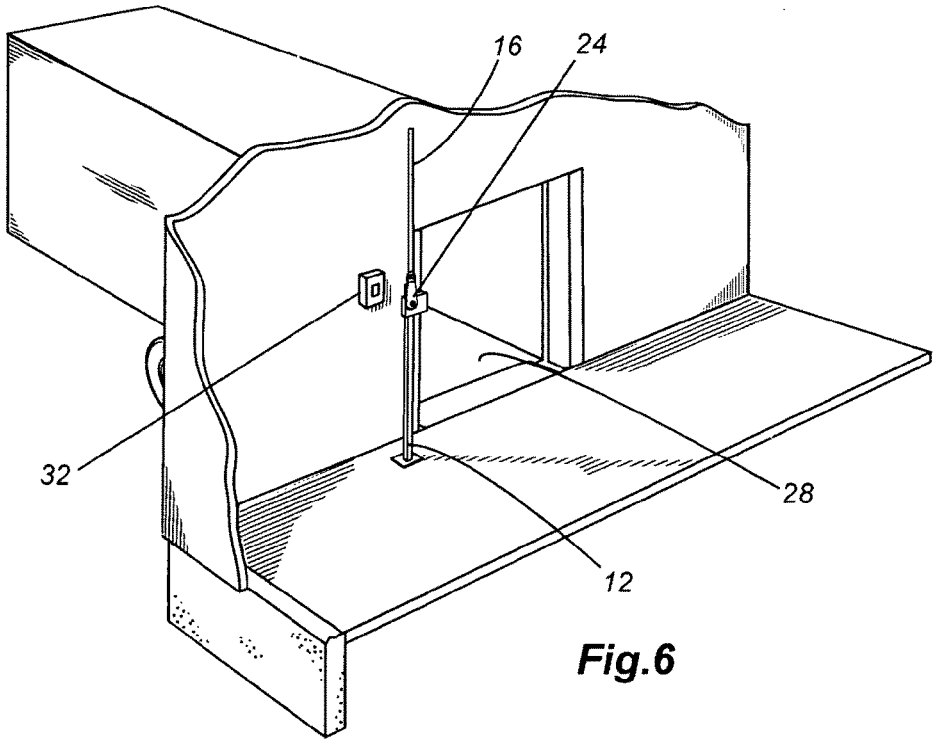
FIG. 6 is an illustration of the barrier in an inoperative position.
Figure 7:
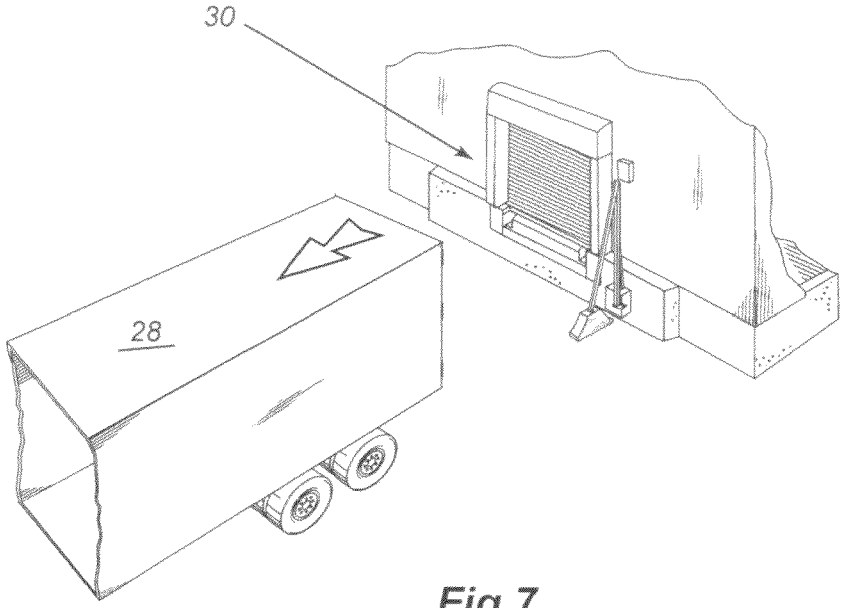
FIG. 7 is a view of the trailer being removed from the loading dock.

FIG. 6 illustrates the position wherein access is permitted to the trailer with the pivot portion 24 having moved to approximately 90° such that bar 16 is in a vertical position and passage is permitted.

If desired, one or more sensors 32 can be utilized to detect when arm 16 is in a certain position.

Figure 8:
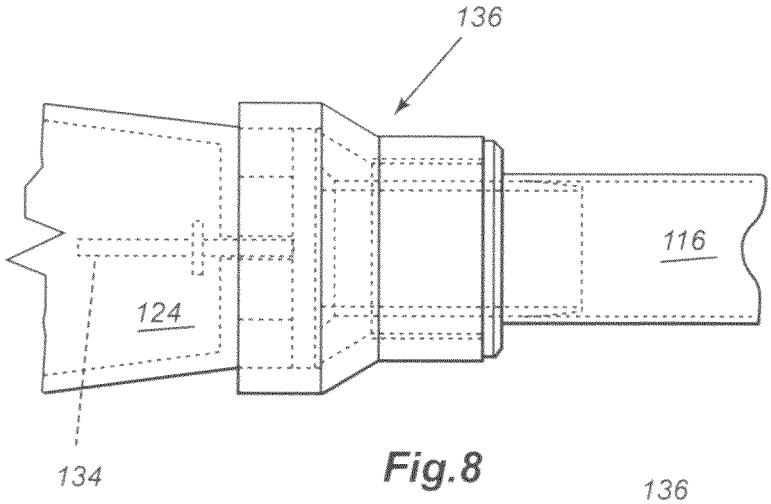
FIG. 8 is a side view of the area wherein the arm is mounted to the pivot portion in a further embodiment of the present invention.
Figure 9:
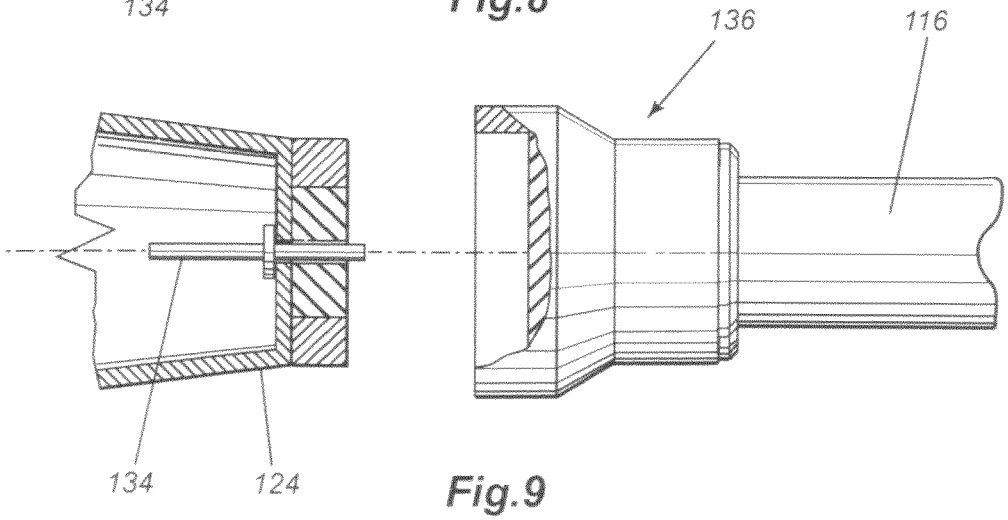
FIG. 9 is an exploded view of FIG. 8.

In the embodiment of FIGS. 8 and 9, a housing 136 is formed about the end of bar 116. Housing 136 provides protection against pinching or the like when mounting bar 116 on pivot portion 124.

This embodiment also utilizes an actuator 134 which comprises a moveable member which will detect when bar 116 is in position or has been rotated or knocked out of position. When bar 116 is mounted on pivot portion 124, actuator 134 is forced by the end of bar 116 inwardly. However, as shown is FIG. 9, actuator 134 will move outwardly due to the magnetic field when bar 116 has been removed or knocked away. Actuator 134 may be connected, for example, to an audible or visual signal or other device to indicate whether bar 116 is in operative position.

The safety device of the present invention may be tied into other systems, both used for safety or other purposes. It will be understood that although the safety device of the present invention has been shown in one particular situation using a loading dock, it can be utilized anywhere where it is desired to restrict movement or indicate the passage is barred. The safety system may use proximity sensors, limit switches, and the like.

Figure 10:
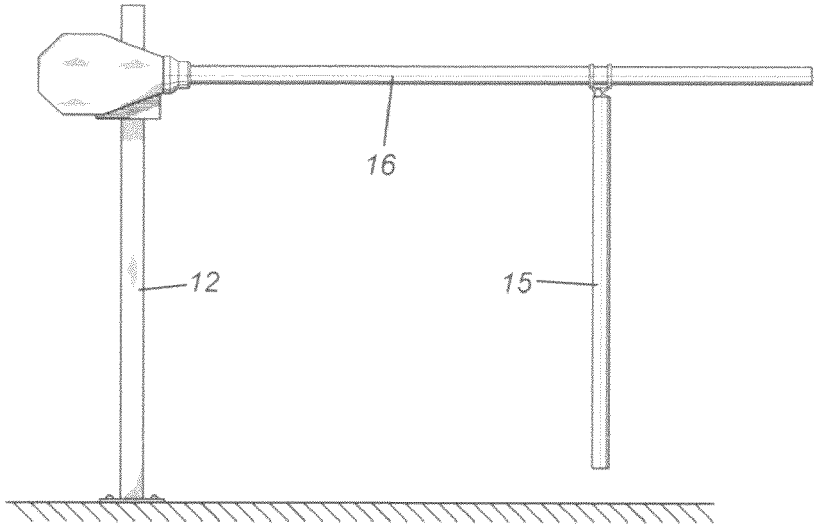
FIG. 10 is a side elevational view of a further embodiment of the present invention when the barrier is in an operative position.
Figure 11:
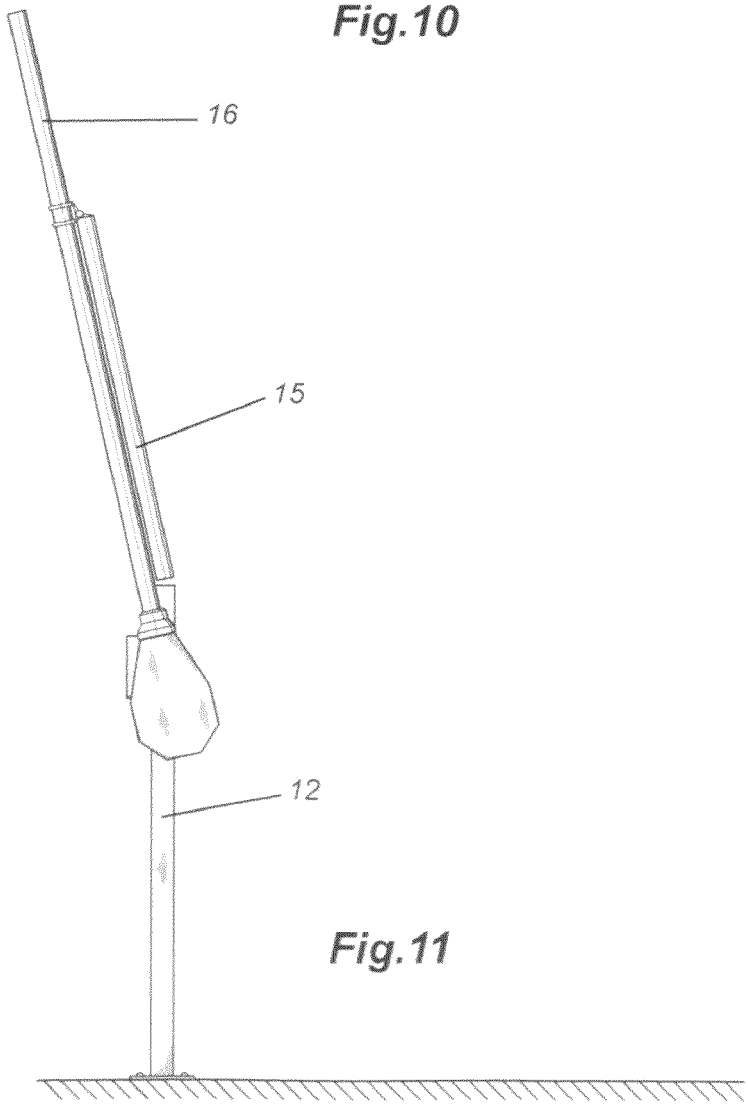
FIG. 11 is a side elevational view thereof in an inoperative position.

In the embodiment of FIGS. 10 and 11, a supplemental rod 15 is utilized in conjunction with barrier 16.

Figure 12:
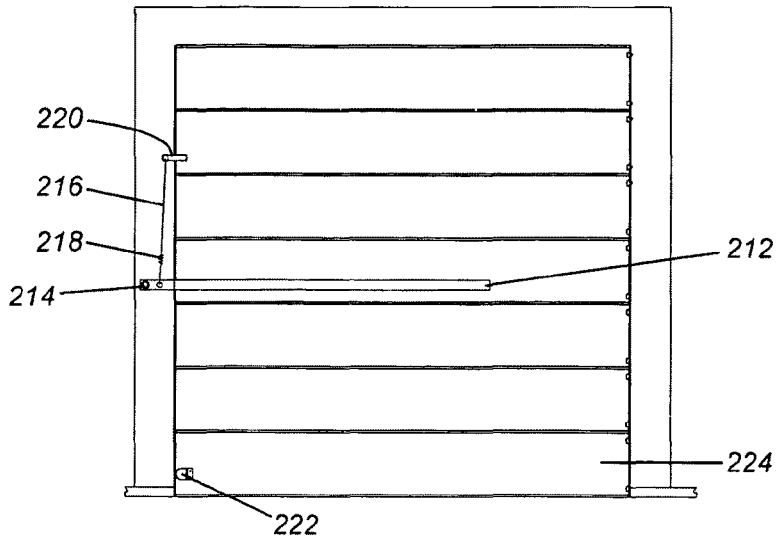
FIGS. 12 to 14 are side elevational views of a further embodiment showing the barrier moving from an operative to an inoperative position.
Figure 13:
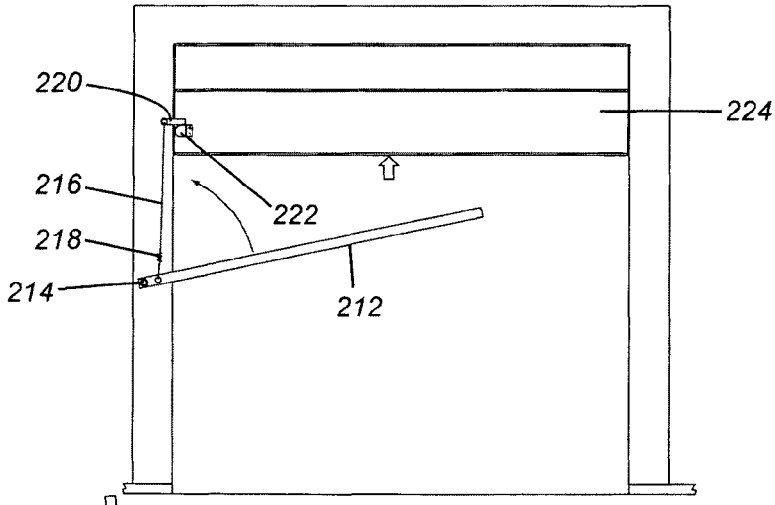
Figure 14:
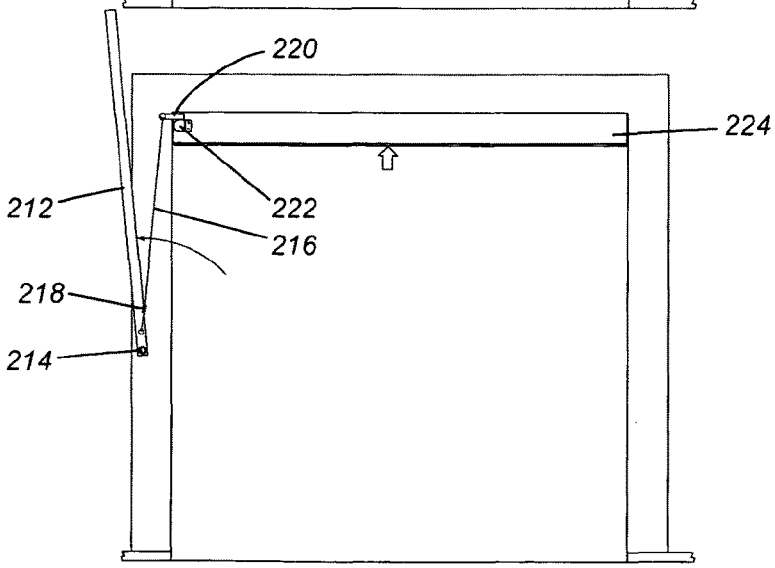

Turning to the embodiment of FIGS. 12 to 14, there is illustrated a barrier 212 which is connected at one end to a pivot point 214. One end of a cable 216 is connected to barrier 212 while the other end is connected to a moveable member 220. A dampening device 218 such as spring, elastic material or rubber may be provided in cable 216. A dampening means can also be mounted on barrier 212.

A protrusion 222 is located at a lower point of a door 224. As it moves upwardly, protrusion 222 engages moveable member 220 thus exerting a force on barrier 212 to cause the same to move upwardly. Moveable member 220 may assume many different forms and may be mounted in a slot or the like such that it will move in a desired path.

It will be understood that the above described embodiment is for purposes of illustration only and the changes and modifications may be made thereto without departing from the spirit and scope of the invention.

I claim:

1. A barrier for securing a passageway, the barrier including:

a mounting device having a pivot portion, the pivot portion being pivotable in a vertical plane between an operative position and an inoperative position;

an elongated bar having a proximal end and a distal end, the bar extending along a longitudinal axis; and two complementary retainer portions, one of the retainer portions being located at an end of the pivot portion and the other of the retainer portions being located at the proximal end of the bar, the bar and the pivot portion being positioned in an end-to-end relationship while being detachably retained together using solely a magnetic connection created between the retainer portions when the retainer portions are in abutment with one another, the magnetic connection resisting detachment of the bar from the pivot portion by gravity when the bar is set horizontally but allowing the proximal end of the bar to completely separate from the pivot portion when the bar is impacted perpendicularly from any direction, the retainer portion located at the proximal end of the bar forming a receptacle inside which the retainer portion located at the end of the pivot portion is inserted when the two retainer portions are in abutment with one another.

2. The barrier of claim 1, further including a sensor to detect a change in position of the bar with reference to the pivot portion.

3. The barrier of claim 2, wherein the sensor is an actuated sensor and the sensor also detects if the bar becomes completely separated from the pivot portion.

4. The barrier of claim 1, wherein at least one of the retainer portions includes a magnet.

5. The barrier of claim 4, wherein each of the retainer portions includes a magnet, the magnets having opposite polarities.

6. The barrier of claim 1, wherein the receptacle is surrounded by a housing to prevent fingers of a user from being pinched when the two retainer portions are brought in abutment with one another.

7. The barrier of claim 1, wherein the retainer portion that is positioned inside the receptacle has an outer surface with a circular cross section and wherein the receptacle includes an inner housing with a circular cross section, the outer surface and the inner surface being coaxially disposed with reference to the longitudinal axis of the bar when the two retainer portions are in abutment with one another.

8. The barrier of claim 7, further including a rod-like member hanging underneath the bar, the rod-like member being in a torque-transmitting engagement with the bar such that a force applied on the rod-like member in a tangential direction with reference to the longitudinal axis of the bar creates a torque between the two retainer portions when the two retainer portions are in abutment with one another.

9. The barrier of claim 1, further including a cable extending between the bar and an adjacent vertically sliding garage door such that when the door is opened or closed, the bar is pivoted and the pivot portion is then automatically pivoted to the inoperative position or the operative position, respectively.

10. The barrier of claim 9, further including a dampening member cooperating with the cable.

11. The barrier of claim 9, further including a dampening member cooperating with the bar.

* * * * *